US010082094B2

(12) United States Patent
Nishio et al.

(10) Patent No.: US 10,082,094 B2
(45) Date of Patent: Sep. 25, 2018

(54) KNOCKING CONTROL METHOD

(71) Applicant: Mitsubishi Heavy Industries, Ltd., Tokyo (JP)

(72) Inventors: Hideki Nishio, Tokyo (JP); Hiroshi Yoshizumi, Tokyo (JP)

(73) Assignee: Mitsubishi Heavy Industries Engine & Turbocharger, Ltd., Kanagawa (JP)

( * ) Notice: Subject to any disclaimer, the term of this patent is extended or adjusted under 35 U.S.C. 154(b) by 0 days.

(21) Appl. No.: 15/542,035

(22) PCT Filed: Dec. 10, 2015

(86) PCT No.: PCT/JP2015/084643
§ 371 (c)(1),
(2) Date: Jul. 6, 2017

(87) PCT Pub. No.: WO2016/111113
PCT Pub. Date: Jul. 14, 2016

(65) Prior Publication Data

US 2017/0370305 A1 Dec. 28, 2017

(30) Foreign Application Priority Data

Jan. 8, 2015 (JP) ..... 2015-002266

(51) Int. Cl.
*F02D 35/00* (2006.01)
*F02D 35/02* (2006.01)
(Continued)

(52) U.S. Cl.
CPC ..... *F02D 35/027* (2013.01); *F02D 19/024* (2013.01); *F02D 41/0027* (2013.01); *F02D 41/0087* (2013.01); *F02P 5/1522* (2013.01)

(58) Field of Classification Search
CPC ..... F02D 19/024; F02D 41/0027; F02D 41/0087; F02D 35/027; F02P 5/1522
See application file for complete search history.

(56) References Cited

U.S. PATENT DOCUMENTS 5,255,637 A * 10/1993 Schechter ..... F02D 13/0234 123/48 R
7,946,275 B2 * 5/2011 McDonald ..... B60W 10/06 123/481
(Continued)

FOREIGN PATENT DOCUMENTS

DE 4037943 A1 6/1992
EP 2330284 A1 6/2011
(Continued)

OTHER PUBLICATIONS

International Search Report, App. No. PCT/JP2015/084643, dated Mar. 1, 2016, 2 Pages.
(Continued)

*Primary Examiner* — Hieu T Vo
*Assistant Examiner* — Sherman Manley
(74) *Attorney, Agent, or Firm* — Berkeley Law & Technology Group, LLP

(57) ABSTRACT

A knocking control method in a power generation system (1) which includes a gas engine (20) including a plurality of air cylinders (21) and a knocking detection unit (51) configured to detect knocking in each of the air cylinders (21). The knocking control method includes a first control step of delaying an ignition timing for at least one of the air cylinders (21) when the knocking detection unit (51) has detected knocking; a second control step of reducing an amount of gas supplied to at least one of the air cylinders (21) when the knocking has not been eliminated by the first control step; and a third control step of shutting off supply of a gas to any of the air cylinders (21) in which the knocking has occurred.

3 Claims, 3 Drawing Sheets

(51) Int. Cl.

| | |
|---|---|
| *F02D 41/00* | (2006.01) |
| *F02P 5/152* | (2006.01) |
| *F02D 19/02* | (2006.01) |

(56) References Cited

U.S. PATENT DOCUMENTS

| | | | | |
|---|---|---|---|---|
| 9,482,202 | B2 * | 11/2016 | Carlson | F02P 5/1522 |
| 9,506,411 | B2 * | 11/2016 | Glugla | F02D 41/0087 |
| 2007/0215107 | A1 * | 9/2007 | Shelby | F02D 41/0087 123/406.26 |
| 2011/0290215 | A1 | 12/2011 | Boewing et al. | |
| 2013/0139786 | A1 * | 6/2013 | Glugla | F02D 41/0087 123/321 |
| 2015/0167573 | A1 * | 6/2015 | Glugla | G01L 23/225 701/104 |
| 2016/0032847 | A1 * | 2/2016 | Suzuki | F02D 41/22 123/435 |

FOREIGN PATENT DOCUMENTS

| | | | |
|---|---|---|---|
| JP | 08074591 | A | 3/1996 |
| JP | 3327696 | B2 | 9/2002 |
| JP | 2007247569 | A | 9/2007 |
| JP | 2012159048 | A | 8/2012 |
| JP | 2014181615 | A | 9/2014 |

OTHER PUBLICATIONS

Written Opinion of the International Searching Authority, App. No. PCT/JP2015/084643, 9 Pages.

* cited by examiner

KNOCKING CONTROL METHOD

TECHNICAL FIELD

The present invention relates to a knocking control method in a gas engine used for a power generation system.

Priority is claimed on Japanese Patent Application No. 2015-002266, filed Jan. 8, 2015, the content of which is incorporated herein by reference.

BACKGROUND ART

In power generation systems using gas engines, in order to stably generate electricity, a combustion abnormality such as knocking needs to be found at an early stage to be prevented.

For example, Patent Literature 1 discloses a control device in which, when it is determined that knocking has occurred in any of the air cylinders in a gas engine on the basis of a value detected using a knock sensor, a supply amount and pressure of a gas with respect to all of the air cylinders are reduced so that a load is lowered or an ignition timing is delayed (a timing retard) and thus the occurrence of knocking is minimized.

CITATION LIST

Patent Literature

[Patent Literature 1]

Japanese Unexamined Patent Application, First Publication No. 2012-159048

SUMMARY OF INVENTION

Technical Problem

However, in the above knocking control method, control is performed on all of the air cylinders provided in the gas engine so that a load is uniformly lowered or an ignition timing is delayed. Since an ignition timing of air cylinders in which knocking has not occurred, that is, normally operating air cylinders, is also delayed when such control is performed, combustion efficiency is lowered and thus an amount of consumption of a gas is likely to be increased. Furthermore, an exhaust temperature in the normally operating air cylinders rises and thus a combustion abnormality such as knocking is also very likely to occur in the normally operating air cylinders. Thus, combustion efficiency in the entire gas engine is lowered and thus an amount of electric power generation in the power generation system is likely to be lowered. For this reason, electricity is less likely to be stably generated without maintaining a constant amount of electric power generation in the power generation system.

The present invention provides a knocking control method in which knocking is minimized while suppressing a decrease in the amount of electric power generation in a power generation system and thus electricity can be stably generated.

Solution to Problem

According to a first aspect of the present invention, a knocking control method in a power generation system which includes a gas engine including a plurality of air cylinders and a knocking detection unit configured to detect knocking in each of the air cylinders, the knocking control method including: a first control step of delaying an ignition timing for at least one of the air cylinders when the knocking detection unit has detected knocking; a second control step of performing load reducing in at least one of the air cylinders when the knocking has not been eliminated by the first control step; and a third control step of shutting off supply of a gas to any of the air cylinders in which knocking has occurred.

According to such a knocking control method, an ignition timing of at least one of the air cylinders in the first control step is delayed so that knocking can be minimized without reducing an amount of electric power generation in the power generation system. Furthermore, since the operation of the gas engine can continue while an ignition timing of the other air cylinders is maintained, a decrease in combustion efficiency in the other air cylinders and a resulting increase in the amount of consumption of a gas can be minimized.

Also, when knocking is not eliminated in the first control step, load reducing in at least one of the air cylinders is performed in the second control step so that a supply amount and pressure of a gas with respect to the entire gas engine is not significantly reduced and thus a load of the relevant air cylinder can be lowered. For this reason, knocking can be minimized while a decrease in the amount of electric power generation in the power generation system is minimized.

In addition, when knocking is not eliminated in the second control step, supply of a gas to air cylinders in which knocking has occurred is shut off in the third control step so that knocking can be minimized in a state in which combustion in normally operating air cylinders continues. For this reason, knocking can be minimized while a decrease in the amount of electric power generation in the power generation system is minimized.

The first to third control steps are performed step by step in this way so that knocking can be minimized while an ignition timing of the normally operating air cylinders is delayed or the total amount of a gas supplied to the gas engine is significantly reduced. Thus, a decrease in the amount of electric power generation of the power generation system can be minimized and thus electricity can be stably generated.

According to a second aspect of the present invention, in the first aspect, the at least one air cylinder may include an air cylinder in which knocking has occurred among the plurality of air cylinders included in the gas engine.

According to such a knocking control method, the first control step and the second control step can be performed in any of the air cylinders in which knocking has occurred. For this reason, knocking can be minimized without changing an ignition timing of normally operating air cylinders and a gas supply amount. Thus, a decrease in combustion efficiency and an increase in the amount of consumption of a gas occurring when an ignition timing has been delayed in normally operating air cylinders can be minimized. Furthermore, when an exhaust temperature in normally operating air cylinders rises, it is possible to prevent a combustion abnormality such as knocking from likely occurring in normally operating air cylinders.

According to a third aspect of the present invention, in the first aspect, the at least one air cylinder may include all of the air cylinders included in the gas engine.

According to such a knocking control method, since the first control step and the second control step can be performed in all of the air cylinders included in the gas engine, a load in the air cylinders can be sufficiently reduced and thus knocking can be minimized more safely.

According to a fourth aspect of the present invention, in any one of the first to third aspects, the total amount of a gas supplied to the gas engine may be reduced at the time of the third control step.

According to such a knocking control method, an increase in the amount of gas supplied to normally operating air cylinders can be suppressed by an amount in which supply of a gas to any of the air cylinders in which knocking has occurred is shut off. For this reason, it is possible to prevent the durability of the gas engine from being lowered or knocking from very likely occurring in normally operating air cylinders due to a gas of a predetermined amount or more being supplied to normally operating air cylinders so that the normally operating air cylinders have an overload condition.

Advantageous Effects of Invention

According to the above knocking control method, electricity can be stably generated by controlling knocking while a decrease in the amount of electric power generation in a power generation system is minimized.

DESCRIPTION OF EMBODIMENTS

Hereinafter, a power generation system 1 according to an embodiment of the present invention will be described with reference to FIGS. 1 to 3.

First, a constitution of the power generation system 1 in this embodiment will be described with reference to FIG. 1.

Figure 1:
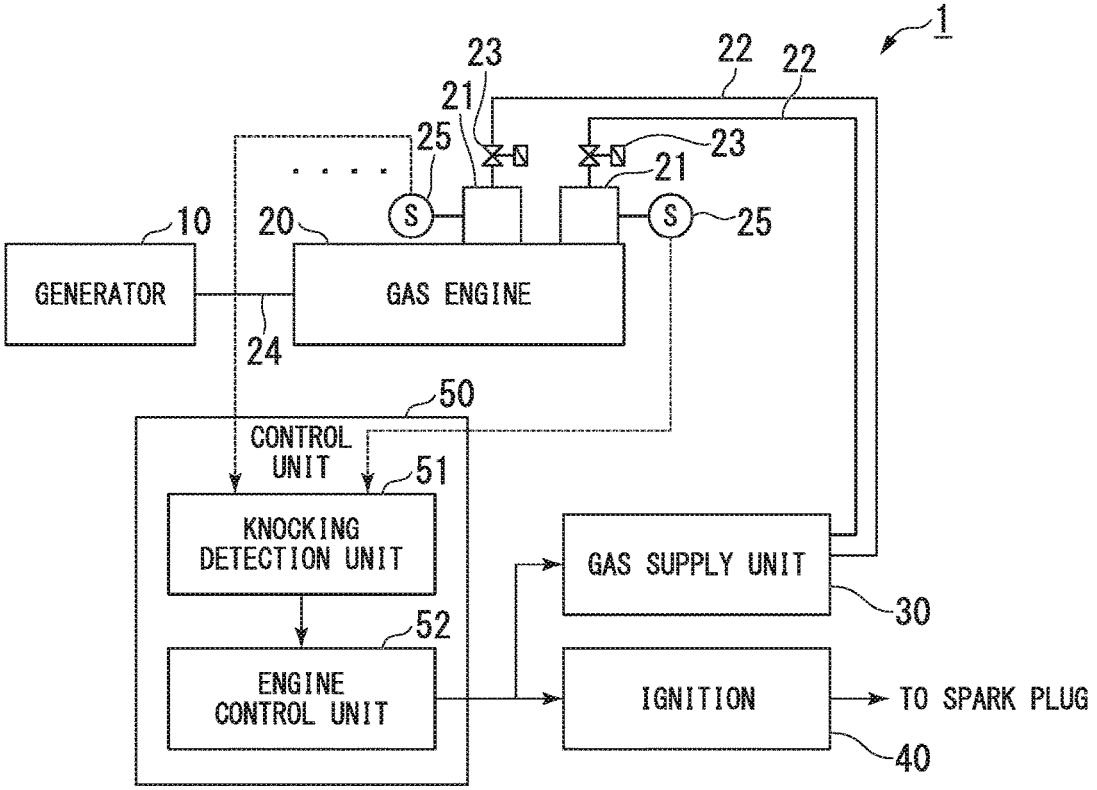
FIG. 1 is a block diagram illustrating a power generation system according to an embodiment of the present invention.

As shown in FIG. 1, in this embodiment, the power generation system 1 includes a gas engine 20, a generator 10 connected to the gas engine 20 via a rotating shaft 24 and configured to generate electricity using a rotational driving force of the gas engine 20, and a control unit 50 configured to control the gas engine 20 and the generator 10.

The gas engine 20 includes a plurality of air cylinders 21. Gas supply pipes 22 configured to supply a gas G from a gas supply unit 30 are connected to the air cylinders 21. Solenoid valves 23 are provided in the gas supply pipes 22 connected to the air cylinders 21. The gas supply pipes 22 are opened and closed using the solenoid valves 23 so that an amount of a gas G supplied from the gas supply pipes 22 to the air cylinders 21 is adjusted or supply of the gas G is stopped (shut off). Furthermore, knock sensors 25 configured to detect knocking in the air cylinders 21 are provided in the air cylinders 21. Examples of the knock sensors 25 include an acceleration sensor.

In this embodiment, a case in which the gas engine 20 includes 18 air cylinders 21 will be described. 18 gas supply pipes 22 are connected to the 18 air cylinders 21, respectively and 18 solenoid valves 23 are provided in the 18 gas supply pipes 22, respectively.

Spark plugs (not shown) configured to ignite a gas G supplied from the gas supply pipes 22 into the air cylinders 21 and combust the gas G are provided inside the air cylinders 21 in the gas engine 20. The spark plugs are controlled to be ignited by an ignition 40 at arbitrary timings The control unit 50 includes a knocking detection unit 51 configured to determine whether knocking has occurred on the basis of signals from the knock sensors 25 provided in the air cylinders 21 and an engine control unit 52 configured to control the gas supply unit 30 used to adjust supply of a gas G to the gas engine 20 and the ignition 40 used to adjust ignition timings of the spark plugs. The control unit 50 controls the gas supply unit 30 and the ignition 40 using the engine control unit 52 to adjust an amount of gas G supplied to the gas engine 20 and ignition timings of the air cylinders 21 in the gas engine 20 and controls an amount of electric power generation in the generator 10.

Next, a knocking control method in the power generation system 1 in this embodiment will be described with reference to FIG. 2.

Figure 2:
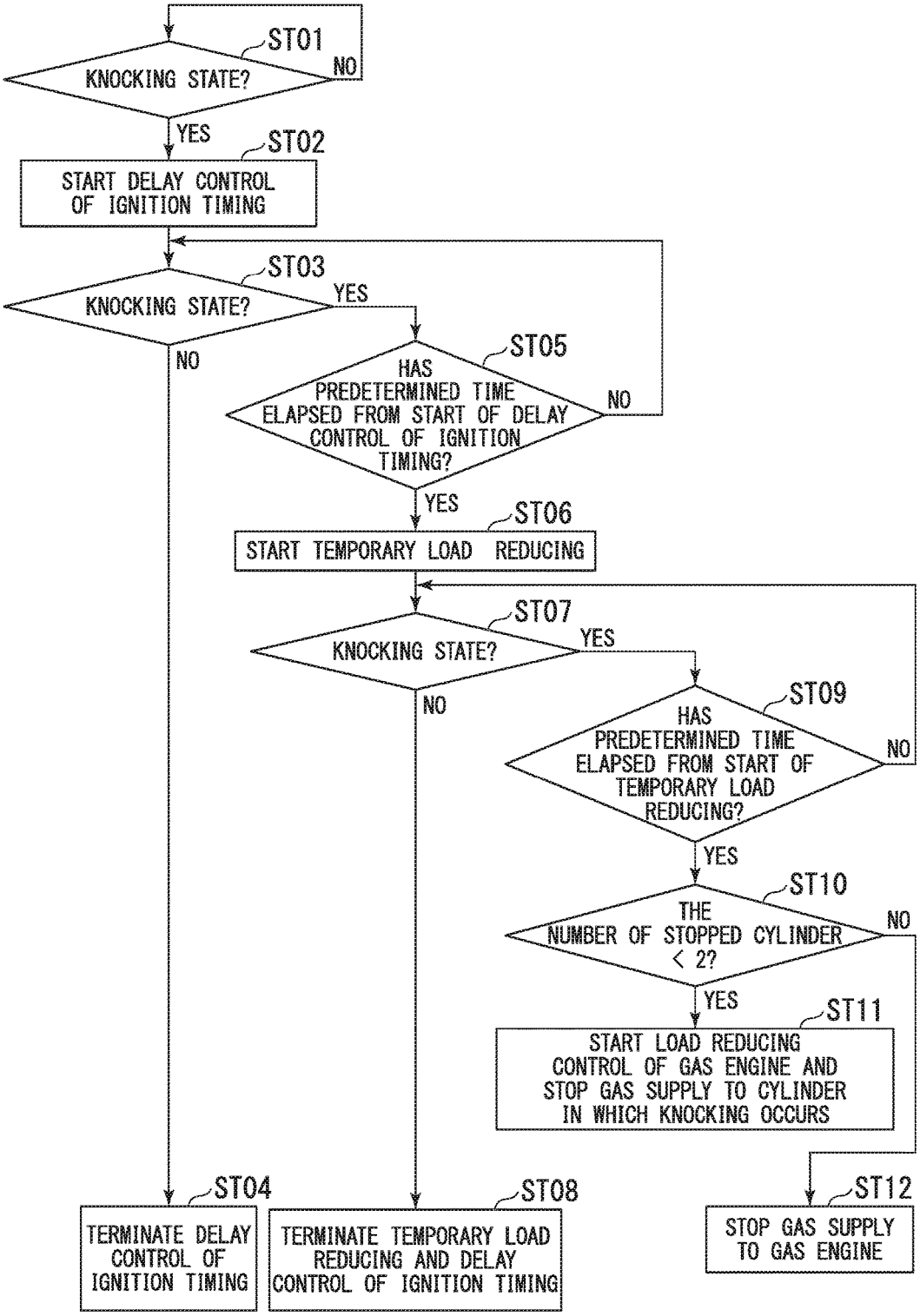
FIG. 2 is a flowchart for describing a knocking control method according to the embodiment of the present invention.

As illustrated in Step ST01 in FIG. 2, the knocking detection unit 51 in the control unit 50 determines whether knocking (a knocking state) has occurred in the air cylinders 21 on the basis of signals from the knock sensors 25 in the air cylinders 21.

Here, when knocking has not occurred in any of the air cylinders 21, that is, when it is determined by the knocking detection unit 51 that knocking has not occurred in the air cylinders 21 (Step ST01: NO), the knocking detection unit 51 repeatedly performs the determination of Step ST01.

Also, when it is determined that knocking has occurred in any air cylinders 21 among the 18 air cylinders 21, for example, a "first air cylinder 21" (Step ST01: YES), the knocking detection unit 51 notifies the engine control unit 52 of information indicating that knocking has occurred in the "first air cylinder 21" (hereinafter referred to as a "knocking state notification"). The engine control unit 52 starts delay control of an ignition timing of the "first air cylinder 21" when notified of the knocking state notification (Step ST02). To be specific, the engine control unit 52 outputs a command to the ignition 40 so that the ignition timing of the "first air cylinder 21" is delayed by a predetermined value per unit time. The ignition 40 continuously delays the ignition timing of the "first air cylinder 21" for a predetermined period of time. A process of Step ST02 is referred to as a first control step.

Delay control of an ignition timing is not limited to control performed on only the "first air cylinder 21." In addition, the delay control may be performed on a plurality of air cylinders 21 and may be performed on all air cylinders 21 included in the gas engine 20.

Figure 3:
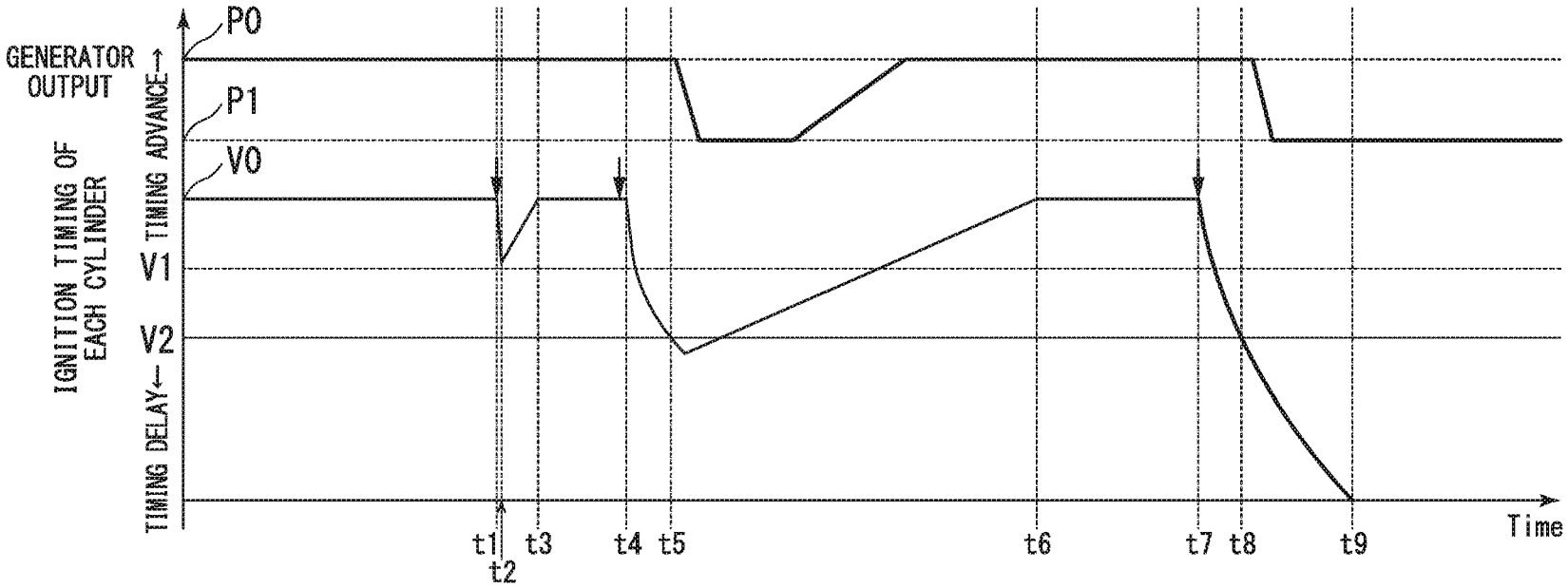
FIG. 3 is a graph for describing an amount of electric power generation in a power generation system and ignition timings in air cylinders of a gas engine according to the embodiment of the present invention.

FIG. 3 is a graph for describing an amount of electric power generation in the power generation system 1 and ignition timings in the air cylinders 21 of the gas engine 20 according to this embodiment. A horizontal axis in FIG. 3 indicates a time axis. A "generator output" described in an upper portion in FIG. 3 represents an amount of electric power generation output by the generator 10 in the graph. A vertical axis indicates the amount of electric power generation of the generator 10. Furthermore, an "ignition timing of each cylinder" described in a lower portion in FIG. 3 represents an ignition timing of each of the air cylinders 21 in the graph. An upper side of the vertical axis indicates a timing advance side and a lower side thereof indicates a timing delay side. In this embodiment, an initial value of an ignition timing of the air cylinder 21 is set to V0.

When it is determined by the knocking detection unit 51 that knocking has occurred in the "first air cylinder 21" at t1 in FIG. 3, the first control step is performed and delay control of the ignition timing of the "first air cylinder 21" is started. Thus, the ignition timing of the "first air cylinder 21" is moved toward the timing delay side after t1 in FIG. 3. At this time, an amount of electric power generation output by the generator 10 is not lowered.

When knocking has not occurred by the first control step at t2 in FIG. 3, that is, when it is determined by the knocking detection unit 51 that knocking has not occurred in the "first air cylinder 21" (Step ST03: NO), the knocking detection unit 51 notifies the engine control unit 52 of information indicating that knocking of the "first air cylinder 21" has been removed (hereinafter referred to as a "knocking removal notification"). The engine control unit 52 terminates the delay control of the ignition timing of the "first air cylinder 21" when notified of the knocking removal notification (Step ST04). To be specific, the engine control unit 52 outputs a command to the ignition 40 so that the timing of the "first air cylinder 21" is advanced to an initial value V0 by a predetermined value per unit time. Thus, the ignition timing of the "first air cylinder 21" is advanced to return to the initial value V0 as illustrated at t2 to t3 in FIG. 3.

Also, a case in which it is determined by the knocking detection unit 51 that knocking has occurred in the "first air cylinder 21" at t4 in FIG. 3 and thus the first control step is performed is illustrated. At this time, when it is determined by the knocking detection unit 51 that knocking has occurred in the "first air cylinder 21" (Step ST03: YES) and a predetermined time does not elapse from the start of the delay control of the ignition timing of the "first air cylinder 21" (Step ST05: NO), the engine control unit 52 continues the delay control of the ignition timing of the "first air cylinder 21." In other words, the engine control unit 52 delays the ignition timing of the "first air cylinder 21" by a predetermined value per unit time. Moreover, the knocking detection unit 51 and the engine control unit 52 repeatedly perform the processes of Step ST03 and Step ST05.

In addition, when such a state has continued, that is, when it is determined by the knocking detection unit 51 that knocking has occurred in the "first air cylinder 21" as illustrated at t5 in FIG. 3 (Step ST03: YES) and a predetermined time has elapsed from the start of the delay control of the ignition timing of the "first air cylinder 21" (Step ST05: YES), the engine control unit 52 starts temporary load reducing (Step ST06). To be specific, the engine control unit 52 outputs a command to the gas supply unit 30 so that the total amount of gas G supplied to the gas engine 20 (all air cylinders 21 included in the gas engine 20) is reduced by a predetermined amount (for example, decreased by 5% with respect to a specified amount of the gas G supplied to the gas engine 20). At this time, the delay control of the ignition timing of the "first air cylinder 21" continues and thus the timing is delayed by a predetermined value per unit time. A process of Step ST06 is referred to as a second control step.

Temporary load reducing is not limited to reducing the total amount of the gas G supplied to the gas engine 20, may include reducing an amount of the gas G supplied to a "first air cylinder 21," and may include reducing an amount of the gas G supplied to a plurality of first air cylinders 21. Furthermore, examples of the temporary load reducing may include reducing a pressure of the gas G in comparison with a specified pressure.

In the second control step, when temporary load reducing starts, as illustrated at t5 in FIG. 3, an output of the generator 10 is reduced in comparison with a specified output amount P0, for example, up to an output amount P1 along with the reduction of the total supply amount of the gas G. Furthermore, since the delay control of the "first air cylinder 21" continues, as illustrated at t5 in FIG. 3, the ignition timing of the "first air cylinder 21" is further moved toward the timing delay side than with the first control step.

When it is determined by the knocking detection unit 51 that knocking has not occurred in the "first air cylinder 21" through the second control step (Step ST07: NO), the knocking detection unit 51 notifies the engine control unit 52 of a knocking removal notification of the "first air cylinder 21." The engine control unit 52 terminates the temporary load reducing when notified of the knocking removal notification and terminates the delay control of the ignition timing of the "first air cylinder 21" (Step ST08). To be specific, the engine control unit 52 outputs a command to the gas supply unit 30 so that the total amount of the gas G supplied to the gas engine 20 is restored to a specified amount. Furthermore, the engine control unit 52 outputs a command to the ignition 40 so that the ignition timing of the "first air cylinder 21" is advanced to the initial value V0. Thus, as illustrated at t5 to t6 in FIG. 3, an output of the generator 10 is restored to the specified output amount P0 and the ignition timing of the "first air cylinder 21" is advanced and returns to the initial value V0.

After that, a process of the knocking detection unit 51 returns to a process of Step ST01 and the process of Step ST01 is repeated.

Also, an example in which the first control step is performed at t7 in FIG. 3 and second control is performed at t8 is illustrated. At this time, when it is determined by the knocking detection unit 51 that knocking has occurred in the "first air cylinder 21" (Step ST07: YES) and a predetermined time does not elapse from the start of the delay control of the ignition timing of the "first air cylinder 21" (Step ST09: NO), the engine control unit 52 continues the delay control of the ignition timing of the "first air cylinder 21." In other words, the engine control unit 52 delays the ignition timing of the "first air cylinder 21" by a predetermined value per unit time. Moreover, the knocking detection unit 51 and the engine control unit 52 repeat the processes of Step ST07 and Step ST09.

In addition, when this state continues, that is, it is determined by the knocking detection unit 51 that knocking has occurred in the "first air cylinder 21" at t8 in FIG. 3 (Step ST07: YES) and a predetermined time has elapsed from the start of the delay control of the ignition timing of the "first air cylinder 21" (Step ST09: YES), the engine control unit 52 determines that an abnormality has occurred in the "first air cylinder 21" in which a knocking state is continuing.

Here, among the 18 air cylinders 21, when the number of air cylinders 21 which have stopped operating is less than two (Step ST10: YES), the engine control unit 52 outputs a command to the gas supply unit 30 so that supply of the gas G to the "first air cylinder 21" is stopped. Thus, the operation of the "first air cylinder 21" stops. Furthermore, the engine control unit 52 outputs a command to the gas supply unit 30 so that load reducing control of the gas engine 20 is started. To be specific, the engine control unit 52 outputs a command to the gas supply unit 30 so that the total amount of the gas G supplied to the gas engine 20 is reduced by an amount corresponding to the number of the air cylinders 21 to which supply of the gas G is stopped (Step ST11). In other words, since supply of the gas G to one air cylinder 21 among the 18 air cylinders 21 is stopped in this example, the engine control unit 52 outputs a command to the gas supply unit 30 so that the total amount of the gas G supplied to the gas engine 20 is reduced by 1/18 thereof. A process of Step ST11 is referred to as a third control step.

Note that the control unit 50 may perform the third control step and notify a manager or the like of the power generation system 1 that the operation of a "first air cylinder 21" has stopped using an alert.

When the third control step is performed, as illustrated at t8 in FIG. 3, an output amount of the generator 10 is reduced in comparison with the specified output amount P0 along with the reduction of the total supply amount of the gas G and is reduced, for example, up to the output amount P1. Note that, since supply of a gas G to a "first air cylinder 21" is stopped, that is, the operation of the "first air cylinder 21" stops, delay control performed on the "first air cylinder 21" is also terminated.

After that, a process of the knocking detection unit 51 returns to a process of Step ST01 and the process of Step ST01 is repeated. Furthermore, the operation of the gas engine 20 continues while the operation of the "first air cylinder 21" has stopped.

Also, when the operation of two of the air cylinders 21 has already stopped by the third control step, for example, when the operation of the "first air cylinder 21" and a "second air cylinder 21" has stopped, if knocking is detected in another air cylinder 21 (for example, a "third air cylinder 21") and a knocking state is not removed even in the first and second control steps (Step ST10: NO), the engine control unit 52 determines that it is difficult to continue the operation of the gas engine 20. For this reason, the engine control unit 52 outputs a command to the gas supply unit 30 so that supply of the gas G to the gas engine 20 is stopped (Step ST12). A process of Step ST12 is referred to as a fourth control step.

Note that the control unit 50 may perform the fourth control step and notify the manager or the like of the power generation system 1 that the operation of the gas engine 20 has stopped using an alert.

Next, effects of this embodiment will be described.

According to the above knocking control method, the control unit 50 can delay an ignition timing of at least one of the air cylinders 21 in the first control step to control knocking without reducing an amount of electric power generation in the power generation system 1 from the specified output amount P0. Furthermore, since the operation of the gas engine 20 can continue while an ignition timing of the other air cylinders 21 is maintained, a decrease in combustion efficiency in the other air cylinders 21 and a resulting increase in the amount of consumption of the gas G can be minimized.

Also, when knocking is not eliminated in the first control step, an amount of the gas G supplied to at least one of the air cylinders 21 can be reduced in the second control step to lower a load of the at least one air cylinder 21 so that the total amount of the gas G supplied to the entire gas engine 20 is not significantly reduced. For this reason, knocking can be minimized while a decrease in the amount of electric power generation in the power generation system 1 is minimized.

In addition, when knocking is not eliminated in the second control step, supply of the gas G to any of the air cylinders 21 in which knocking has occurred in the third control step is shut off so that knocking can be minimized in a state in which combustion has continued in normally operating air cylinders 21, that is, any of the air cylinders 21 in which knocking has not occurred. For this reason, knocking can be minimized while a decrease in the amount of electric power generation in the power generation system 1 is minimized.

The first to third control steps are performed step by step in this way so that knocking can be minimized while a decrease in the amount of electric power generation in the power generation system is minimized. Thus, electricity can be stably generated in the power generation system 1.

According to the above knocking control method, the first control step and the second control step may be performed on only any of the air cylinders 21 for which knocking is determined to have occurred therein. For this reason, knocking can be minimized without changing an ignition timing and a gas G supply amount of normally operating air cylinders 21, that is, any of the air cylinders 21 in which knocking has not occurred. Thus, a decrease in combustion efficiency and an increase in the amount of consumption of the gas G which occur when an ignition timing has been delayed in the normally operating air cylinders 21 can be minimized. Furthermore, when an exhaust temperature of the normally operating air cylinders 21 rises, it is possible to minimize the likely occurrence of a combustion abnormality such as knocking in the normally operating air cylinders 21. For this reason, in the power generation system 1, a combustion abnormality in the air cylinders 21 is minimized and thus electricity can be stably generated.

According to the above knocking control method, the first control step and the second control step may be performed on all of the air cylinders 21 included in the gas engine 20. As a result, a load applied to the air cylinders 21 can be sufficiently reduced and thus knocking can be minimized more safely.

According to the above knocking control method, when supply of the gas G to any of the air cylinders 21 for which knocking is determined to have occurred therein has stopped in the third control step, that is, when the operation of the air cylinder 21 has stopped, the total amount of the gas G supplied to the gas engine 20 may be reduced by an amount corresponding to the number of air cylinders 21 which have stopped operating. Thus, an increase in the amount of the gas G supplied to the normally operating air cylinders 21 can be minimized. For this reason, it is possible to prevent the durability of the gas engine 20 from being lowered or knocking from very likely occurring in normally operating air cylinders 21 due to a gas of a predetermined amount or more being supplied to normally operating air cylinders 21 so that the normally operating air cylinders have an overload condition. As a result, in the power generation system 1, a combustion abnormality in the air cylinders 21 is minimized and thus electricity can be stably generated.

According to the above knocking control method, when it is determined that knocking has occurred in another air cylinder 21 and a state in which knocking has occurred is not removed even in the first and second control steps in a state in which operation of two of the air cylinders 21 has been already stopped by the third control step, the control unit 50 may stop supply of the gas G to the gas engine 20 by the fourth control step. Thus, it is possible to prevent the balance of the gas engine 20 from deteriorating due to stoppage of operation of three or more air cylinders 21 so that combustion efficiency is lowered or the gas engine 20 operates in a state in which the gas engine 20 has an overload condition. For this reason, the operation of the gas engine 20 can be safely stopped.

According to the above knocking control method, when the third control step and the fourth control step have been performed, the manager or the like of the power generation system 1 is notified using an alert. Thus, the manager or the like of the power generation system 1 can easily ascertain that the operation of an air cylinder 21 in the gas engine 20 has stopped or the operation of the gas engine 20 has stopped.

Although the embodiment of the present invention has been described in detail above, the present invention is not limited thereto and some changes in design are also possible without departing from the technical idea of the present invention.

For example, an example in which the gas engine 20 has 18 air cylinders 21 has been described in the above-described embodiment, but the number of air cylinders 21 is not limited to 18 and any number may be used.

Also, an example in which supply of the gas G to the gas engine 20 is stopped (the operation of the gas engine 20 is stopped) when knocking in another air cylinder 21 cannot be eliminated even in the first and second control steps in a state in which the operation of two of the air cylinders 21 has stopped, has been described, but the present invention is not limited thereto. If the operation of the gas engine 20 is not unstable, the operation of the gas engine 20 may continue even when three or more air cylinders 21 have been stopped.

Also, a control method of performing the second control step when knocking is detected even after a predetermined time has elapsed from the performing of the first control step in the above-described embodiment has been described. However, the present invention is not limited to such a control method. In addition, when an ignition timing of any of the air cylinders 21 in which knocking has occurred in the first control step is delayed up to a predetermined value (for example, V1 in FIG. 3) through delay control performed on the air cylinder 21, the second control step may be performed. Similarly, when the ignition timing of the air cylinder 21 has been delayed up to a predetermined value (for example, V2 in FIG. 3) from the performing of the second control step, the third control step may be performed. Even with such control, the same effects as those of the above-described embodiment can be obtained.

In addition, a control method in which, when the third control step and the fourth control step have been performed in the above-described embodiment, the manager or the like of the power generation system 1 is notified using an alert has been described. However, the present invention is not limited to such a control method. In addition, even when the first control step and the second control step have been performed, the manager or the like of the power generation system 1 may be notified using an alert. The manager or the like of the power generation system 1 can easily ascertain a state of the power generation system 1 through such control.

INDUSTRIAL APPLICABILITY

According to the above knocking control method, knocking is minimized while a decrease in the amount of electric power generation in a power generation system is minimized so that electricity can be stably generated.

REFERENCE SIGNS LIST

1 Power generation system
10 Generator
20 Gas engine
21 Air cylinder
22 Gas supply pipe
23 Solenoid valve
24 Rotating shaft
30 Gas supply unit
40 Ignition
50 Control unit
51 Knocking detection unit
52 Engine control unit
G Gas

The invention claimed is:

1. A knocking control method in a power generation system which includes a gas engine including a plurality of air cylinders and a knocking detection unit configured to detect knocking in each of the air cylinders on the basis of knocking sensors included in the plurality of air cylinders, the knocking control method comprising:

a first control step of delaying an ignition timing for at least one air cylinder of the plurality of air cylinders in which knocking has been detected when the knocking detection unit has detected knocking;

a second control step of performing load reducing in at least one of the air cylinders when the knocking of the at least one air cylinder has not been eliminated by the first control step;

a third control step of shutting off supply of a gas to the at least one air cylinder and stopping operation of the at least one air cylinder when the knocking of the at least one air cylinder has not been eliminated by the second control step;

a step of repeatedly performing the first, second, and third control steps in a step by step manner on at least another air cylinder of the plurality of air cylinders in which the knocking has been detected in a state that the operation of the at least one air cylinder has been stopped by the third control step; and a fourth control step of stopping supply of a gas to the gas engine and stopping the gas engine when the number of air cylinders in which operation has been stopped by the step of repeatedly performing reaches a predetermined number and the knocking of at least one of the remaining air cylinders among the plurality of air cylinders in which the knocking has been detected has not been eliminated by the first control step and the second control step.

2. The knocking control method according to claim 1, wherein the total amount of a gas supplied to the gas engine is reduced at the time of the third control step.

3. The knocking control method according to claim 1, wherein the first control step is continuously performed when the second control step has started.

* * * * *